US011008536B2

(12) United States Patent
Smith et al.

(10) Patent No.: US 11,008,536 B2
(45) Date of Patent: May 18, 2021

(54) LIQUID PRODUCT FOR STAINLESS-STEEL CORROSION REMEDIATION

(71) Applicant: AMERICAN STERILIZER COMPANY, Mentor, OH (US)

(72) Inventors: Thomas William Smith, St. Louis, MO (US); Nancy-Hope Elizabeth Kaiser, Collinsville, IL (US); Kathleen Ann Fix, Willoughby, OH (US)

(73) Assignee: American Sterilizer Company, Mentor, OH (US)

( * ) Notice: Subject to any disclaimer, the term of this patent is extended or adjusted under 35 U.S.C. 154(b) by 166 days.

(21) Appl. No.: 16/352,171

(22) Filed: Mar. 13, 2019

(65) Prior Publication Data

US 2020/0291335 A1 Sep. 17, 2020

(51) Int. Cl.

| | |
|---|---|
| ***C11D 1/14*** | (2006.01) |
| ***C11D 3/36*** | (2006.01) |
| ***C11D 3/30*** | (2006.01) |
| ***C11D 7/26*** | (2006.01) |
| ***C11D 7/36*** | (2006.01) |
| ***C11D 1/24*** | (2006.01) |
| ***C11D 7/32*** | (2006.01) |
| ***C11D 1/22*** | (2006.01) |
| ***C11D 3/33*** | (2006.01) |
| ***C11D 3/20*** | (2006.01) |

(52) U.S. Cl.

CPC ..... *C11D 7/265* (2013.01); *C11D 1/143* (2013.01); *C11D 1/22* (2013.01); *C11D 1/24* (2013.01); *C11D 3/2082* (2013.01); *C11D 3/30* (2013.01); *C11D 3/33* (2013.01); *C11D 3/361* (2013.01); *C11D 7/3218* (2013.01); *C11D 7/36* (2013.01)

(58) Field of Classification Search

CPC .... C11D 1/22; C11D 3/30; C11D 3/33; C11D 3/361; C11D 3/2082

USPC ..... 510/238, 245, 269, 274, 469, 480, 499, 510/477, 488

See application file for complete search history.

(56) References Cited

U.S. PATENT DOCUMENTS

| | | | | |
|---|---|---|---|---|
| 3,854,996 | A | 12/1974 | Frost et al. | |
| 2005/0079992 | A1 | 4/2005 | Smith | |
| 2006/0287209 | A1* | 12/2006 | Chaigne | C11D 7/265 510/238 |
| 2012/0227766 | A1* | 9/2012 | Hafer | C11D 3/30 134/8 |
| 2013/0210695 | A1* | 8/2013 | Bjelopavlic | C11D 3/042 510/470 |
| 2013/0345112 | A1 | 12/2013 | Sun et al. | |

(Continued)

OTHER PUBLICATIONS

International Search Report and Written Opinion for corresponding PCT application PCT/US2020/015778 dated Apr. 14, 2020.

*Primary Examiner* — Gregory R Delcotto

(74) *Attorney, Agent, or Firm* — Hudak, Shunk & Farine Co. LPA

(57) ABSTRACT

A concentrate aqueous composition for removing Type I and Type III rouge from various stainless-steel items. The liquid composition comprises oxalic acid, a phosphonic acid, and various amines. The use of an amine has been found to provide synergistic results in removal of the noted types of corrosion from various stainless-steel items that include medical instruments, machines, equipment, pipes, tools, mixing and storage vessels, and the like.

19 Claims, 4 Drawing Sheets

(56) References Cited

U.S. PATENT DOCUMENTS

| | | | | |
|---|---|---|---|---|
| 2014/0090663 | A1* | 4/2014 | Woo | C11D 3/2072 134/6 |
| 2017/0015947 | A1* | 1/2017 | Cermenati | C11D 3/43 |
| 2017/0321165 | A1* | 11/2017 | Stokes | C11D 3/10 |
| 2017/0362544 | A1* | 12/2017 | Nakajima | C11D 1/04 |
| 2018/0237727 | A1* | 8/2018 | Nakajima | C11D 3/2065 |
| 2019/0330568 | A1* | 10/2019 | Ceulemans | C11D 3/2079 |

* cited by examiner (Prototypes based on HEDP + oxalic acid system are better against Type I rouge than Commercial Product A or Commercial Product B)

HEDP: Hydroxyethylidene diphosphonic acid
ATMP: Aminotrimethylene phosphonic acid
DTPMP: Diethylenetriamine penta(methylene phosphonic acid)
PBTC: 2-phosphonobutane-1,2,4-ricarboylic acid
BHMTPMPA: bis(hexamethylene triamine penta(methylenephosphonic acid))

LIQUID PRODUCT FOR STAINLESS-STEEL CORROSION REMEDIATION

FIELD OF THE INVENTION

A concentrate aqueous composition is set forth to remove Type I and Type III rouge from various stainless-steel items such as machines, equipment, pipes, tools, mixing and storage vessels, and especially from various items in the medical, pharmaceutical, and other health care industries. The liquid composition comprises oxalic acid, or oxalic acid dihydrate, phosphonic acids, various amines, and optionally various surfactants and water. The use of an amine has generally been found to provide synergistic results in removal of Rouge III Type corrosion from various stainless-steel items.

BACKGROUND OF THE INVENTION

When stainless-steel has not been maintained properly, it can be susceptible to corrosion. Development of corrosion in various items as in manufacturing equipment, piping, machines, tools, etc., can shorten the life span of such items. This corrosion material is commonly known as rouge, and comprises iron oxides, such as ferric oxide ($Fe_2O_3$), ferrous oxide (FeO), and magnetite ($Fe_3O_4$).

The process by which corrosion material is removed from stainless-steel surfaces is often referred to as "derouging." The efficacy of the derouging process can be evaluated by measuring the solubility of iron oxide in solution or by visual or gravimetric evaluation of rouge removal from stainless-steel surfaces.

Previously, U.S. Pat. No. 3,854,996 (Frost et al., Haliburton Company) described removing magnetite scale with an aqueous solution consisting of polyphosphonic acid, or an alkali metal or amine salt of such acid. The pH of the solution was adjusted using ammonium hydroxide preferably to a pH range between 9 and 10.25 and was used for scale removal at a temperature between 180° F. and 300° F.

Several currently-marketed products have some efficacy in removing corrosion consisting of ferric oxide, known as "Type I Rouge". However, it is much more challenging to remove corrosion consisting of magnetite. In industry, the magnetite corrosion material is often known as "Type III Rouge" and generally forms in the presence of high temperature steam. Weaker acids, such as acetic acid and citric acid, do not solubilize magnetite well and are not efficacious in removing magnetite corrosion material. Stronger acids, such as hydrochloric acid or hydrofluoric acid, are reported to have better efficacy in removing corrosion material, but can cause further damage to stainless-steel and have significant safety and handling concerns. Other compositions which have corrosion removal capability, such as described in the aforementioned patent, require higher use temperature and longer treatment times (up to 24 hours) and can include the use of ammonium hydroxide in the process.

SUMMARY OF THE INVENTION

The present invention relates to a liquid concentrate composition that has the capability to solubilize and/or remove corrosion material (rouge) comprising ferric oxide, ferrous oxide, as well as magnetite, i.e. $Fe_3O_4$, and the like. The overall composition comprises a combination of oxalic acid or oxalic acid dihydrate, or both, and a phosphonic acid, desirably with an amine and optionally a hydrotrope or a surfactant system that contributes to solubilizing or wetting and dispersing properties of the composition, especially on stainless-steel surfaces, and water.

A concentrate stainless-steel liquid corrosion remediation composition, comprises an oxalic acid in an amount of at least about 0.2 wt. % to about 10 wt. %; one or more phosphonic acids in an amount of from about 10 wt. % to about 30 wt. %; one or more amines; optionally one or more hydrotrope surfactants, and optionally one or more surfactants that is capable of wetting, dispersing, or emulsifying said concentrate composition; and wherein said weight percent amounts are based on the 100 total parts by weight of said concentrate composition.

DETAILED DESCRIPTION OF THE INVENTION

Figure 1:
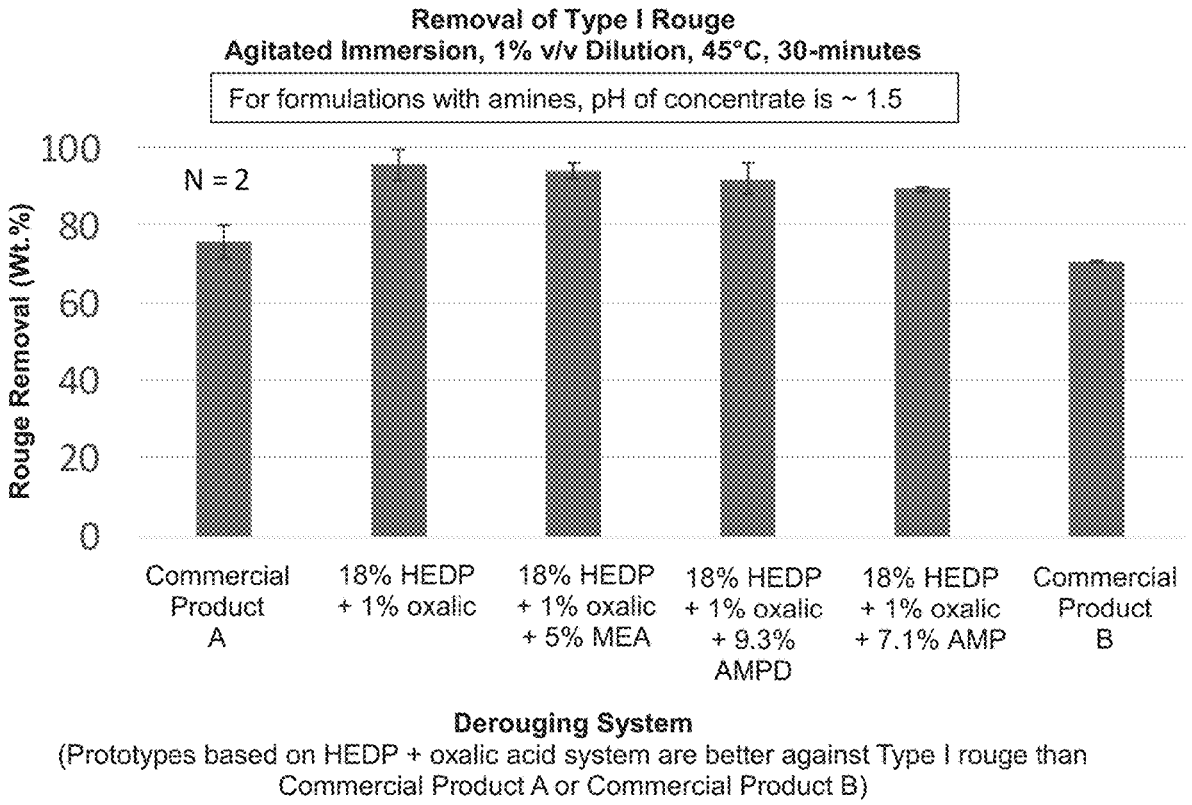
FIG. 1 relates to the efficacy of various Type I Derouging compositions.

The concentrate aqueous or liquid remediation composition of the present invention has been found to be effective in removing corrosion material from stainless-steel items or substrates. By way of terms of the art, "Type I Rouge" refers to a deposit corrosion material, that is treated as a "soil" is generally reddish-orange in color and composed of ferric oxide ($Fe_2O_3$), or ferrous oxide (FeO), or iron oxide-hydroxide (FeO(OH)),. "Type II Rouge" is similar in composition to Type I and can be removed from a stainless-steel substrate but damage to the substrate such as pitting cannot be repaired with only a chemical treatment. Such corroded types of substrates require a polishing treatment to be repaired. "Type III Rouge" relates to corrosion on stainless-steel surfaces that generally occur under high pressure and/or high temperature systems. The corrosion is generally magnetite, that is $Fe_3O_4$, wherein the iron-oxygen bonds are short and thus are very strong and difficult to break. Accordingly, this type of corrosion is difficult to remove from the stainless-steel substrate. However, the present invention has been found to effectively treat Type I as well as Type III Rouge type systems.

The liquid (e.g. aqueous) concentrate corrosion remediation composition of the present invention generally comprises oxalic acid or oxalic acid dihydrate, or both, one or more phosphonic acids. It has been unexpectedly found that when one or more amines are added to the corrosion remediation composition, significant and synergistic results, are obtained with regard to solubilizing magnetite or Type III Rouge. Optionally, but desirably, various surfactants are used that are stable in an acidic environment and also low foaming, such as hydrotrope surfactants or various wetting surfactants that are capable of wetting, dispersing, or emulsifying the corrosion remediation composition.

The stainless-steel liquid corrosion remediation composition of the present invention is generally discussed with respect to being a concentrate. Accordingly, it can be diluted with various amounts of a solvent such as water, alcohol, etc., so that it can then be applied to a stainless-steel substrate to remove Rouge therefrom. Usual amounts of dilution relate to adding an amount of solvent, e.g. water, so that the volume of the concentrated stainless-steel liquid corrosion remediation composition is from about 0.5% to about 50%, desirably from about 1% to about 20%, and preferably from about 5% to about 15% of the total volume of the added water, etc., and the added concentrated solution.

The weight percent of the various compounds utilized throughout the present invention and that which is claimed is the weight per se of the active compound that constitutes the formulation item of the present invention as set forth in the various figures. That is, it is the amount of only the "active" material that is part of the compound and not any other ingredient that serves to solubilized, dissolve, etc., the active compound per se. Thus, if 20 parts by weight of a specific ingredient is added to form part of the concentrated corrosion remediation composition and the active amount of the specific ingredient is 80 wt. %, the total weight of the active ingredient added to the liquid corrosion remediation composition is 16 parts by weight. With respect to the total amount of the various ingredients, compounds, etc., that form the concentrate stainless-steel liquid remediation composition of the invention, it is 100 parts by weight or 100 wt. %. Thus, the active component per se constitutes a fraction of the total 100 parts by weight, and the remaining water, solvent, etc., of the active compound constitutes another portion of the total 100 parts by weight.

An important aspect of the present invention is the utilization of a dicarboxylic acid such as oxalic acid or oxalic acid dihydrate, or both, in small amounts (active) such as from about 0.2 to about 10, desirably from about 0.5 to about 5.0, and preferably from about 0.8% to about 1.2% with 1% by weight being highly preferred, based upon the total weight of the concentrate liquid corrosion remediation composition, i.e. 100%.

Another compound of the concentrate liquid corrosion remediation composition of the present invention is one or more phosphonic acids with suitable examples including hydroxyethylidene diphosphonic acid (H EDP), diethylenetriamine penta(methylene phosphonic acid (DTPMP), bis (hexamethylene triamine penta(methylene phosphonic) acid (BHMTPMPA), aminotrimethylene phosphonic acid (ATMP), and 2-phosphonobutane-1,2,4-tricarboxylic acid (PBTC).

The active amount of the one or more phosphonic acids is from about 10 wt. % to about 30 wt. %, desirably from about 14 wt. % to about 25 wt. %, and preferably from about 16 wt. % to about 20 wt. % with about 18 wt. % being highly preferred, based upon the total weight of the concentrate liquid corrosion remediation composition, (i.e. 100 parts by weight or 100 wt. %) of the present invention.

An important aspect of the present invention relates to the utilization of one or more amines as, for example a primary amine. It has been found that synergistic results are obtained, especially with regard to magnetite solubility when such compounds are utilized in combination with one or more different types of phosphonic acids or one or more phosphonates along with a small amount of oxalic acid and/or oxalic acid dihydrate. That is, a Magnetite solubility (PPM) increase of at least about 150%, at least about 175%, and even at least about 190% are achieved. The active amount of the amines is generally from about 3 wt. % to about 20 wt. %, desirably from about 4 wt. % to about 15 wt. %, and preferably from about 5 wt. % to about 13 wt. % based upon 100% by weight of the total concentrate liquid corrosion mediation compositions of the present invention. Examples of suitable amines include monoethanol amine (MEA), monoisopropanol amine (MIPA), aminomethyl propanol (AMP), aminomethyl propane diol (AMDP), and triethanolamine (TEA) .

The pH of said above concentrated compositions comprising said one or more phosphonic acids, said small amount of oxalic acid, etc., is generally from about 1.0 to about 3.0 or 4.0, desirably from about 1.2 to about 2.0, and preferably from about 1.3 to about 1.6.

An optional aspect of the present invention relates to the use of one or more hydrotropic surfactants or various "wetting" surfactants that aid in wetting, dispersing, or emulsifying the corrosion remediation compositions of the invention as set forth above, especially with regard to compositions containing one or more primary or secondary amines. Examples of such hydrotropic surfactants include sodium caprylyl sulfonate, disodium octylaminodipropionate, sodium xylene sulfonate, octyldimethylamine oxide, an alkyl glucoside wherein said alkyl group has from about 8 to about 14 carbon atoms, or any combination thereof.

Examples of suitable wetting surfactants include various sodium alkyl sulfates having from about 6 to about 18 carbon atoms, or ethoxylated alcohols that have been found to be stable in an acetic environment and are low foaming. Specific examples include an aromatic ethoxylate such as 4-mole phenol ethoxylate, 6-mole phenol ethoxylate, 8-mole phenol ethoxylate, or any combination thereof.

The active amounts of the one or more hydrotrope surfactants generally ranges from about 0.4 wt. % to about 5 wt. %, desirably from about 0.6 wt. % to about 2.0 wt. %, and preferably from about 0.8 wt. % to about 1.2 wt. % based upon the total weight (100%) of the concentrate liquid corrosion remediation compositions of the present invention. The active amounts of the one or more wetting agents is from about 0.4 to about 5 wt. %; desirably from about 0.6 to about 2.0 wt. %, and preferably from about 0.8 to about 1.2 wt. % based on the total weight of the concentrated composition.

In addition to the amount of the non-active solvent, e.g. water, etc. components of the various active compounds (e.g. phosphonic acids, etc.), the amount of water utilized to make a concentrated total 100 parts by weight of the stainless-steel liquid corrosion remediation composition is from about 30 to about 86 wt. %, desirably from about 51 to about 81 wt. %, and preferably from about 71 to about 78 wt. % based upon 100 total parts by weight of the liquid corrosion remediation composition concentrate. As noted above, the composition of the present invention can be diluted to a suitable amount for application to a stainless-steel substrate.

The invention will be better understood by reference to the following examples which serve to illustrate but not to limit the present invention.

Commercial Product A is an acid system containing phosphoric acid and citric acid, and Commercial Product B is a solution comprising citric acid and oxalic acid. Both of these products are currently used for removal of Type I Rouge and passivation.

Example 1—Type I Derouging—Coupon Study

FIG. 1 relates to results wherein existing commercial derouging solutions of A and B were utilized in comparison with mixtures of oxalic acid, a phosphonic acid, and amine compounds of the present invention. Pre-weighed stainless-steel panels with lab-generated rouge were immersed in 1% v/v dilutions of each chemistry in deionized water maintained at 45° C. under agitated conditions. After 30 minutes, the stainless-steel panels were removed from the dilution and rinsed with deionized water. After the panels were allowed to dry, a final weight of each panel was recorded and the rouge removal was calculated as a weight percentage. The results are shown in FIG. 1.

As set forth in FIG. 1, the Type I Rouge removal utilizing existing commercial products, i.e. commercial product A and commercial product B was about 76 wt. % and 71 wt. %, respectively, whereas the composition of the present invention utilizing 18 wt. % of HEDP and 1% of oxalic acid various amounts of an amine yielded a removal of approximately 90 yd. % to about 95 wt. %.

Figure 2:
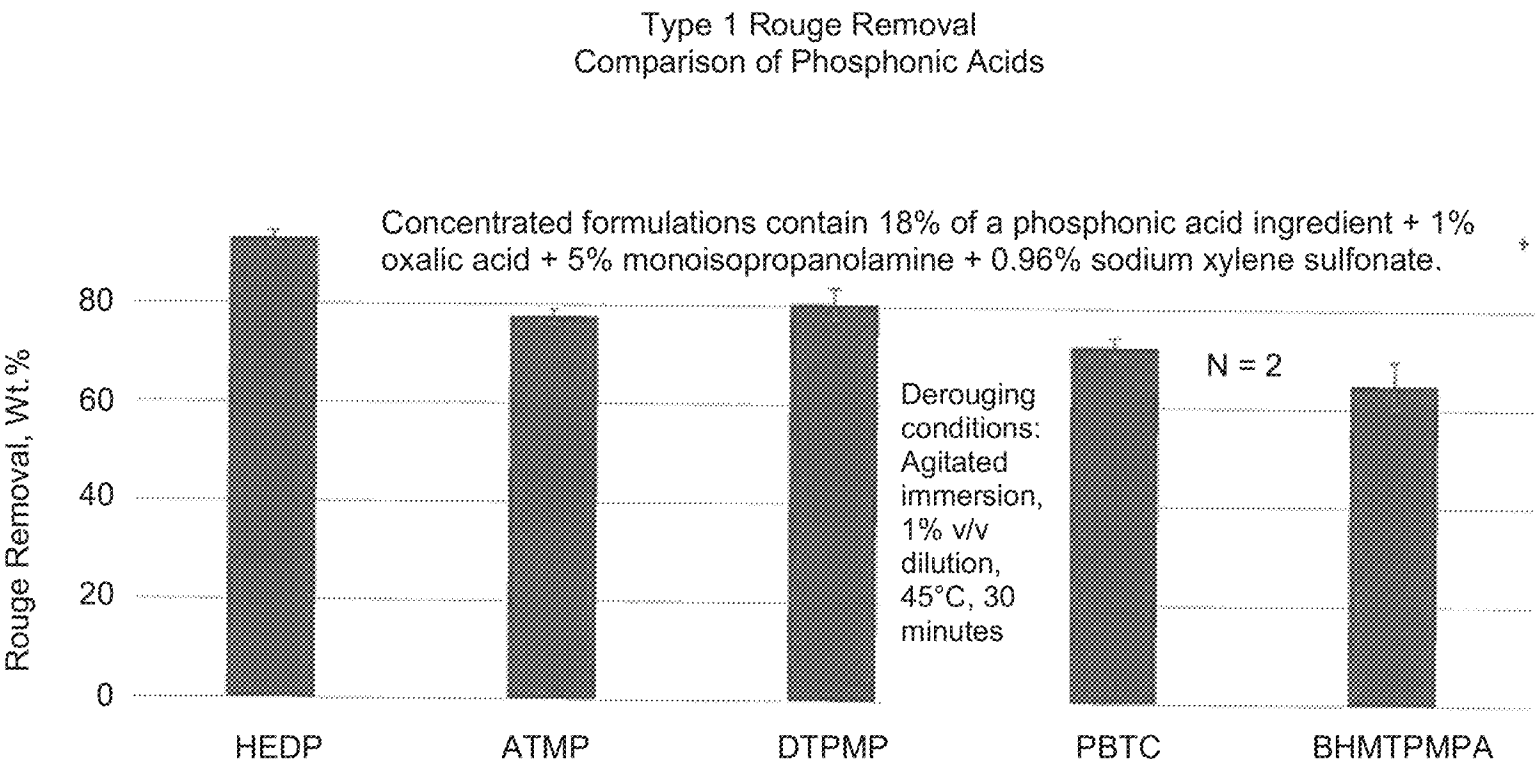
FIG. 2 relates to the efficacy of various Type I Derouging compositions containing oxalic acid, different types of phosphonic acids, an amine and a surfactant.

FIG. 2 relates to various Type I Rouge removal compositions wherein five different types of phosphonic acids were utilized. The stainless-steel panels were prepared in a manner as set forth with respect to FIG. 1. As apparent from FIG. 2, HEDP had the best performance with a Type I Rouge removal of at least 90% whereas phosphonic acids of ATMP and DTPMP gave a Type I Rouge removal of approximately 80%, and PBTC and BHMTPMDA gave a Type I removal of about 73% and about 66%, respectively.

Type III Derouging (Magnetite)

Figure 3:
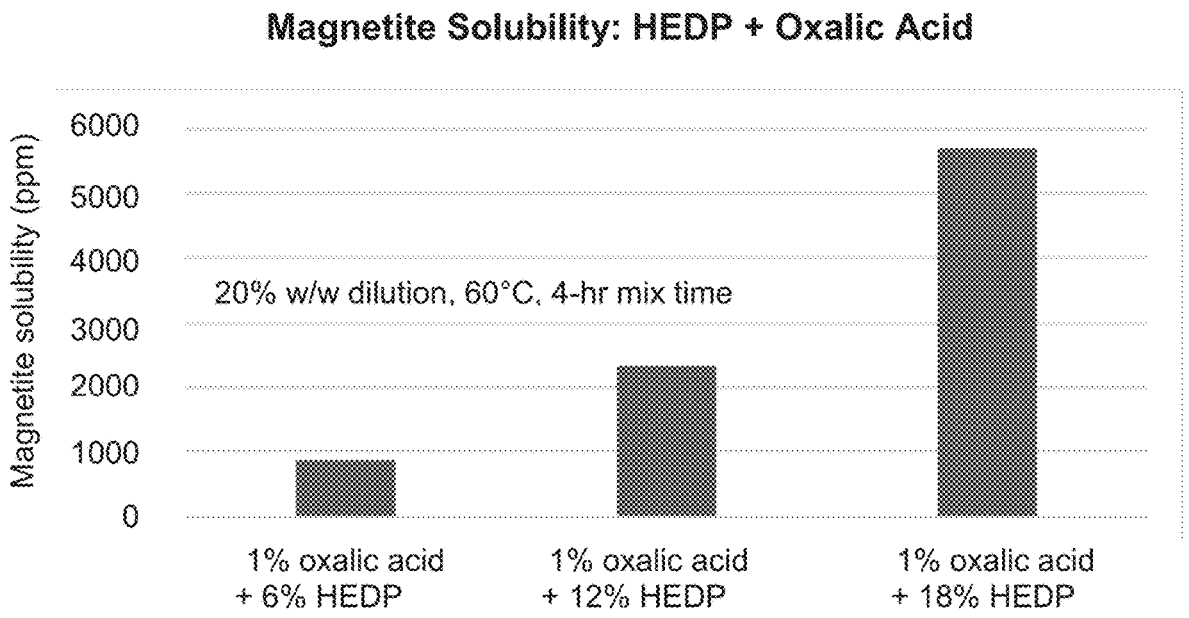
FIG. 3 relates to the Magnetite Solubility of various Type III remediation compositions containing oxalic acid and different amounts of HEDP acid.

As shown in FIG. 3, compositions of oxalic acid and a phosphonic acid such as HEDP, the solubility of magnetite therein was limited due to the strong FeO bonds, although it did increase with larger amounts of HEDP. The magnetite solubility shown in FIG. 3 was obtained by preparing a 20% w/w dilution of each formula in deionized water and heating to 60° C. under agitated conditions. An amount of magnetite equivalent to 2% of the total dilution weight was added to the dilution. The mixture was maintained at 60° C. while agitating for four hours. After four hours, a sample from each mixture was taken and filtered to remove undissolved magnetite. The filtered sample was then analyzed to determine the amount of dissolved magnetite. As shown in FIG. 3, solubility was generally increased by utilizing larger amounts of the phosphonic acid with a magnetite solubility value of approximately 5,500 PPM (parts per million) being obtained utilizing a solution of 1% of oxalic acid with 18% by weight of HEDP.

Figure 4:
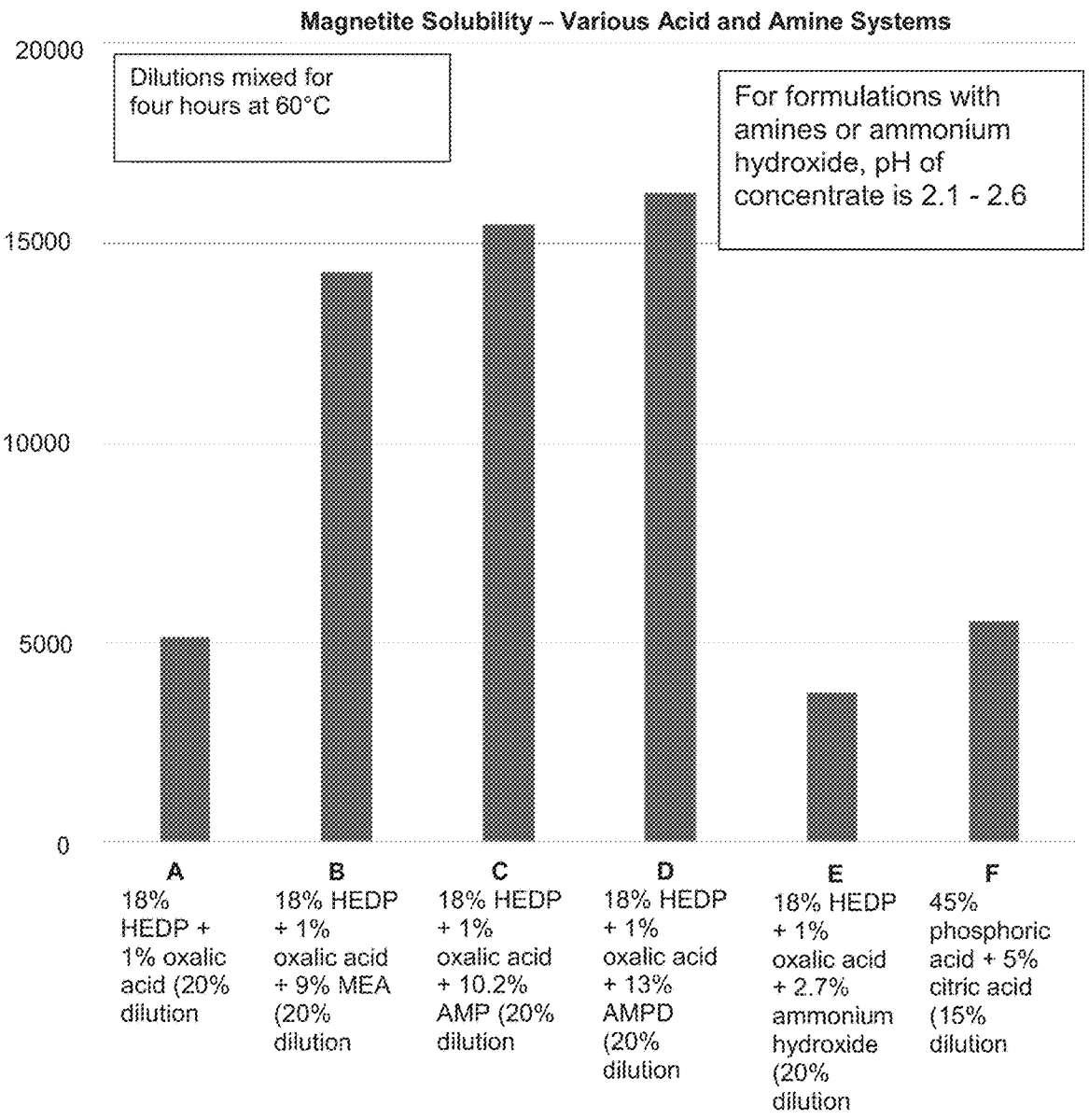
FIG. 4 relates to Magnetite solubility of various Type III compositions containing oxalic acid, HEDP, and different amines.

Unexpectedly large and synergistic improvements with regard to magnetite solubility were obtained when one or more amines were utilized in combination with oxalic acid and a phosphonic acid (HEDP) as shown in FIG. 4. The magnetite solubility study was performed in a manner as set forth with respect to FIG. 3.

As shown in FIG. 4, Example E comprising 18% by weight of HEDP, 1% by weight of oxalic acid, and 2.7% by weight of ammonium hydroxide (20% dilution) achieved a low magnetite solubility values of about 4,000 ppm. Slightly higher magnetite soluble values (~5,000 ppm) were obtained in example A, 18% HEDP plus 1% oxalic acid (20% dilution). The commercial composition of Example F, 45% phosphoric acid by weight, 5% citric acid by weight (15% dilution) achieved a low magnetite solubility of about 5,500 ppm (15% dilution).

In contrast thereto, examples B, C, and D of the present invention, wherein 1% oxalic acid, 18% of HEDP, and respectively 9% MEA, 10.2% AMP, and 13% of AMPD were utilized, achieved approximately an unexpected 3-fold improvement of magnetite solubility of approximately 15,000 ppm.

Since strong acids such as hydrochloric acid, hydrofluoric acid, sulfuric acid, and the like can cause damage, not only to stainless-steel, but also to human beings and injure the same, the present invention excludes such acids. That is, the corrosion remediation compositions of the present invention are substantially free of such compounds meaning that generally 1 wt. % or less, desirably 0.5 wt. % or less, and preferably nil, i.e. 0 wt. %, or no amounts whatsoever of such strong acids are utilized based upon the total weight of the remediation solution. Also, as noted above, generally mild acids such as acetic acid, citric acid, lactic acid, formic acid, and glutamic acid, are not utilized since they do not have a high level of efficiency in removing Type I Rouge corrosion. Accordingly, the liquid corrosion remediation compositions of the present invention are substantially free thereof, meaning that if utilized, very small amounts thereof are used such as about 1 wt. % or less, desirably about 0.5 wt. % or less, or preferably, nil or no amounts by weight thereof whatsoever are utilized, based upon the total weight of the remediation solution.

While in accordance with the Patent Statutes, the best mode and preferred embodiments have been set forth, the scope of the invention is not limited thereto, but rather, by the scope of the attached claims.

What is claimed is:

1. A concentrated stainless steel liquid corrosion remediation composition, comprising:

oxalic acid or an oxalic acid dihydrate, or both, in an amount of at least about 0.2 wt. % to about 10 wt. %;

one or more phosphonic acids comprising at least one of hydroxyethylidene diphosphonic acid (HEDP), diethylenetriamine penta(methylene phosphonic acid) (DTPMP), bis(hexamethylene triamine penta(methylene phosphonic) acid (BHMTPMPA), aminotrimethylene phosphonic acid (ATMP), or 2-phosphonobutane-1,2,4-tricarboxylic acid (PBTC), in an amount of from about 10 wt. % to about 30 wt. %;

one or more amines comprising at least one of monoethanolamine (MEA), monoisopropnaolamine (MIPA), aminomethylpropanol (AMP), aminomethyl propanediol (AMPD), or triethanolamine (TEA), in an amount from about 3 wt. % to about 20 wt. %;

optionally one or more hydrotrope surfactants, and optionally one or more surfactants that is capable of wetting, dispersing, or emulsifying said concentrate composition;

a solvent system; and wherein said weight percent amounts are based on the 100 total parts by weight of said concentrate composition.

2. The concentrated stainless steel liquid corrosion remediation composition of claim 1, wherein when utilized the total amount of said one or more hydrotrope surfactants is from about 0.4 wt. % to about 5 wt. %; and wherein when utilized the total amount of said one or more wetting surfactants is from about 0.4 wt. % to about 5 wt. %.

3. The concentrated stainless steel liquid corrosion remediation composition of claim 1, wherein the amount of said oxalic acid or an oxalic acid dihydrate, or both, is from about 0.5 wt. % to about 5.0 wt. %; wherein the amount of said one or more amines is from about 4 wt. % to about 15 wt. %; wherein the amount of said one or more phosphonic acids is from about 14 wt. % to about 25 wt. %; wherein the amount of said one or more hydrotrope surfactants is from about 0.6 wt. % to about 2.0 wt. %; and wherein the amount of said one or more wetting surfactants is from about 0.6 wt. % to about 2.0 wt. %.

4. The concentrated stainless steel liquid corrosion remediation composition of claim 3, wherein the amount of said oxalic acid or an oxalic acid dihydrate, or both, is from about 0.8 wt. % to about 1.2 wt. %; wherein the amount of said one or more phosphonic acids is from about 16 wt. % to about 20 wt. %; wherein the amount of said one or more amines is from about 5 wt. % to about 13 wt. %; and comprising said hydrotrope surfactant.

5. The concentrated stainless steel liquid corrosion remediation composition of claim 3, comprising said one or more hydrotropes, wherein said one or more hydrotrope surfactants comprises sodium caprylyl sulfonate or sodium xylene sulfonate, or both.

6. The concentrated stainless steel liquid corrosion remediation composition of claim 5, comprising said one or more wetting surfactants comprising sodium alkyl sulfate having from about 6 to about 18 carbon atoms.

7. The concentrated stainless steel liquid corrosion remediation composition of claim 4, wherein said phosphonic acid comprises said hydroxyethylidene diphosphonic acid.

8. The concentrated stainless steel liquid corrosion remediation composition of claim 1, wherein said concentrated stainless steel liquid corrosion remediation composition is capable of removing Type I Rouge.

9. The concentrated stainless stool liquid corrosion remediation composition of claim 2, wherein said concentrated stainless steel liquid corrosion remediation composition is capable of removing Type I Rouge.

10. The concentrated liquid corrosion remediation composition of claim 4, wherein said concentrated stainless steel liquid corrosion remediation composition is capable of removing Type I Rouge.

11. The concentrated stainless steel liquid corrosion remediation composition of claim 1, wherein said concentrated stainless steel liquid corrosion remediation composition is capable of removing Type III Rouge.

12. The concentrated liquid corrosion remediation composition of claim 3, wherein said concentrated stainless steel liquid corrosion remediation composition is capable of removing Type Ill Rouge.

13. The concentrated stainless steel liquid corrosion remediation composition of claim 3, wherein said concentrated stainless steel liquid corrosion remediation composition is capable of removing Type Ill Rouge.

14. A concentrated stainless liquid corrosion remediation composition comprising:

an oxalic acid or an oxalic acid dihydrate, or both, in an amount of at least about 0.2 wt. % to about 10 wt. %;

one or more phosphonic acids comprising at least one of hydroxyethylidene diphosphonic acid (HEDP), diethylenetriamine penta(methylene phosphonic acid) (DTPMP), bis(hexamethylene triamine penta(methylene phosphonic) acid (BHMTPMPA), aminotrimethylene phosphonic acid (ATMP), or 2-phosphonobutane-1,2,4-tricarboxylic acid (PBTC), in an amount of from about 10 wt. % to about 30 wt. %;

one or more amines comprising at least one of monoethanolamine (MEA), monoisopropnaolamine (MIPA), aminomethylpropanol (AMP), aminomethyl propanediol (AMPD), or triethanolamine (TEA), wherein the total amount of said one or more amines is from about 3 wt.% to about 20 wt.%;

a solvent system; and one or more hydrotrope surfactants;

wherein said weight percent amounts are based upon 100 total parts by weight of said concentrated composition.

15. The concentrated stainless steel liquid remediation composition of claim 14, wherein the amount of said one or more hydrotrope surfactants is from about 0.4 wt.% to about 5 wt. %.

16. The concentrated stainless steel liquid corrosion remediation composition of claim 15, wherein the amount of said oxalic acid or an oxalic acid dihydrate, or both, is from about 0.5 wt. % to about 5.0 wt. %; wherein the amount of said one or more amines is from about 4 wt. % to about 15 wt. %; wherein the amount of said one or more phosphonic acids is from about 14 wt. % to about 25 wt. %; and wherein the amount of said one or more hydrotrope surfactants is from about 0.6 to about 2.0 wt. %.

17. A concentrated stainless steel liquid corrosion remediation composition comprising:

oxalic acid or an oxalic acid dihydrate, or both, in an amount of at least about 0.2 wt. % to about 10 wt. %;

one or more phosphonic acids comprising at least one of hydroxyethylidene diphosphonic acid (HEDP), diethylenetriamine penta(methylene phosphonic acid) (DTPMP), bis(hexamethylene triamine penta(methylene phosphonic) acid (BHMTPMPA), aminotrimethylene phosphonic acid (ATMP), or 2-phosphonobutane-1,2,4-tricarboxylic acid (PBTC), in an amount of from about 10 wt. % to about 30 wt. %;

one or more amines comprising at least one of monoethanol amine (MEA), monoisopropanol amine (MIPA), aminomethyl propanol (AMP), aminomethyl propanediol (AMPD), or triethanolamine (TEA), in an amount from about 3 wt. % to about 20 wt. %;

a solvent system ; and one or more surfactants that are capable of wetting, dispersing, or emulsifying said concentrate composition;

wherein said weight percent amounts are based upon 100 total parts by weight of said concentrated composition.

18. The concentrated stainless steel liquid corrosion remediation composition of claim 17, wherein the amount of said one or more wetting surfactants is from about 0.4 wt. % to about 5 wt. %.

19. The concentrated stainless steel liquid corrosion remediation composition of claim 18, wherein the amount of said oxalic acid or an oxalic acid dihydrate, or both, is from about 0.5 wt. % to about 5.0 wt. %; wherein the amount of said one or more amines is from about 4 wt. % to about 15 wt. %; wherein the amount of said one or more phosphonic acids is from about 14 wt.% to about 25 wt. %; and wherein the amount of said one or more wetting surfactants is from about 0.6 w. t% to about 2.0 wt. %.

* * * * *